US005845588A

United States Patent [19]

Gronnevik

[11] Patent Number: 5,845,588

[45] Date of Patent: Dec. 8, 1998

[54] PLASTIC PALLET

[75] Inventor: Oddbjorn Gronnevik, Nesbru, Norway

[73] Assignee: Borealis A/S, Lyngby, Denmark

[21] Appl. No.: 739,642

[22] Filed: Oct. 30, 1996

[30] Foreign Application Priority Data

Jan. 11, 1996 [NO] Norway ..... 960128

[51] Int. Cl.[6] ..... B65D 19/00

[52] U.S. Cl. ..... 108/57.27; 108/57.25; 108/901

[58] Field of Search ..... 108/51.1, 901, 108/902, 56.3, 51.11, 57.27, 57.26, 57.25, 57.28, 57.34

[56] References Cited

U.S. PATENT DOCUMENTS

| | | | |
|---|---|---|---|
| 3,667,403 | 6/1972 | Angelbeck, Jr. | 108/901 X |
| 3,719,157 | 3/1973 | Arcocha et al. | 108/901 X |
| 3,868,915 | 3/1975 | Hafner | 108/901 X |
| 3,880,092 | 4/1975 | Seeber et al. | 108/901 X |
| 3,915,098 | 10/1975 | Nania | 108/51.1 |
| 3,938,448 | 2/1976 | Nishitani et al. | 108/51.1 |
| 4,007,694 | 2/1977 | Fowler et al. . | |
| 4,397,246 | 8/1983 | Ishida et al. | 108/901 X |
| 4,397,247 | 8/1983 | Lemelson | 108/901 X |
| 5,046,434 | 9/1991 | Breezer et al. | 108/901 X |
| 5,052,307 | 10/1991 | Morrison | 108/901 X |
| 5,417,167 | 5/1995 | Sadr . | |
| 5,555,820 | 9/1996 | Shuert | 108/901 X |

FOREIGN PATENT DOCUMENTS

| | | | |
|---|---|---|---|
| 226505 | 6/1987 | European Pat. Off. | 108/901 |
| 2612153 | 9/1988 | France | 108/901 |
| 1292136 | 10/1972 | United Kingdom | 108/901 |

*Primary Examiner*—José V. Chen
*Attorney, Agent, or Firm*—Kirkpatrick & Lockhart LLP

[57] ABSTRACT

A pallet fabricated made of a thermoplastic material is produced by joining together individually fabricated structural components, each individually thermoformed from an extruded plastic parison of a multilayer structure. The structural components include a deck in the form of a continuous sheet with longitudinal and transverse sides, one or more upper runner components fastened by their top side to the bottom of the deck, each of which includes a cross member with downward-facing posts, and one or more lower runner components, each of which includes a cross member with upward-facing posts and which is fastened by the tops of its posts to the bottoms of matching posts on the corresponding upper runner components.

27 Claims, 2 Drawing Sheets

PLASTIC PALLET

FIELD OF INVENTION

The invention relates to a plastic pallet, in particular a pallet fabricated by joining together several components into a finished pallet, wherein the individual components are fabricated from a thermoplastic material by forming. The pallet can also be furnished with reinforcing sections.

PRIOR ART

Pallets are included as a part of the goods that are to be transported and/or stored on them, and therefore it is important for the pallet to be lightweight, but strong and rigid at the same time. Plastic pallets have the advantages over wooden pallets that they are lightweight, that they do not absorb moisture, and that they can be cleaned/disinfected, which is decisive in fields where hygiene is important, e.g., in the food industry. At the same time such pallets have to have a smooth and even surface without dead angles and nearly inaccessible corners where dirt can collect. A disadvantage of plastic pallets is that thermoplastic materials will deflect when they are subjected to static loads over time. For this reason, for many purposes plastic pallets are reinforced by various means.

U.S. Pat. No. 2,503,022 discloses a wooden pallet assembled from individually fabricated components according to the prefabricated module principle. The individual components comprise a pallet deck and upper and lower runner components that have legs with channels and raised sections that fit into one another. The upper runner components run transversely along the pallet deck, while the lower runner components run longitudinally along the deck. The components are fastened mechanically with bolts, and the construction results in a rigid pallet. It is added that the pallet can be fabricated from plywood, fiberboard, plastic or lightweight metals, without further specification as regards this.

European Patent No. 0 400 640 discloses a plastic pallet that is assembled from a top deck and a bottom deck with runners, or from a deck and runners. The components are formed with legs that are inserted into one another during assembly. Mechanical fasteners in the form of metal plates having die-cut notches, nails or the like can be employed in order to ensure that the components hold together. Both the top deck and bottom deck are constructed with exposed stiffening reinforcing ribs.

Swiss Patent No. 685549 A5 discloses a plastic pallet that is injection molded in two components, namely, a top deck and a bottom deck comprising posts and runners. The top deck and the bottom deck have reinforcing ribs running both transversely and longitudinally, in a rectangular pattern. The top deck and bottom deck are butt-welded together so that the side edges and ribs get to be welded together against one another. Directly within all four side edges and in the center longitudinally there are in the ribs semicircular openings into which steel pipes or flat rods can be jammed for mechanical reinforcement of the pallet. The plastic pallet is preferably fabricated from polyethylene, and it is designed for use, among other things, in the food and pharmaceuticals industry. The pallet can also be used as a stackable pallet.

Prior art plastic pallets are fabricated by the injection molding of components that are then joined together. The components will typically have reinforcing ribs at required places in order to attain lightweight rigid construction. In the injection molding of such large objects, very large expensive injection molding tools are used that require large injection molding machines having great clamping force. Consequently, it would be desirable to be able to make plastic pallets by a simpler and more economical method. A possible means of attaining this object is to make the pallet from an extruded sheet of plastic, preferably by thermoforming. Such a sheet can be extruded flat by means of a conventional flat-sheeting die, or as a parison, as is done in the blow molding of large objects like barrels, gasoline tanks, etc.

It is often desirable to employ a coextruded multilayer structure where one of the layers is at least partially foamed. For instance, in the specification of U.S. Pat. No. 4,874,649 a method is described for the blow molding of a coextruded parison comprising at least two layers, one of which, perhaps more, is at least partially foamed.

SUMMARY OF THE INVENTION

It has now been found that it is possible to fabricate a pallet from individually fabricated components, where these components are formed from a coextruded multilayer parison, where at least one of the layers is at least partially foamed. Thus, the invention provides a pallet made of a thermoplastic material, fabricated by joining together a number of individually fabricated structural components, each of which is thermoformed from an extruded plastic parison having a multilayer structure. The structural components comprise:

(a) a deck in the form of a continuous sheet having a longitudinal and a transverse side, (b) one or more upper runner components that are fastened by their top side to the bottom of the deck, each comprising a cross member with downward-facing posts, and (c) one or more lower runner components, each of which comprises a cross member with upward-facing posts and which is fastened by the tops of its posts to the bottoms of matching posts on the corresponding upper runner component.

SPECIFICATION

Figure 1:
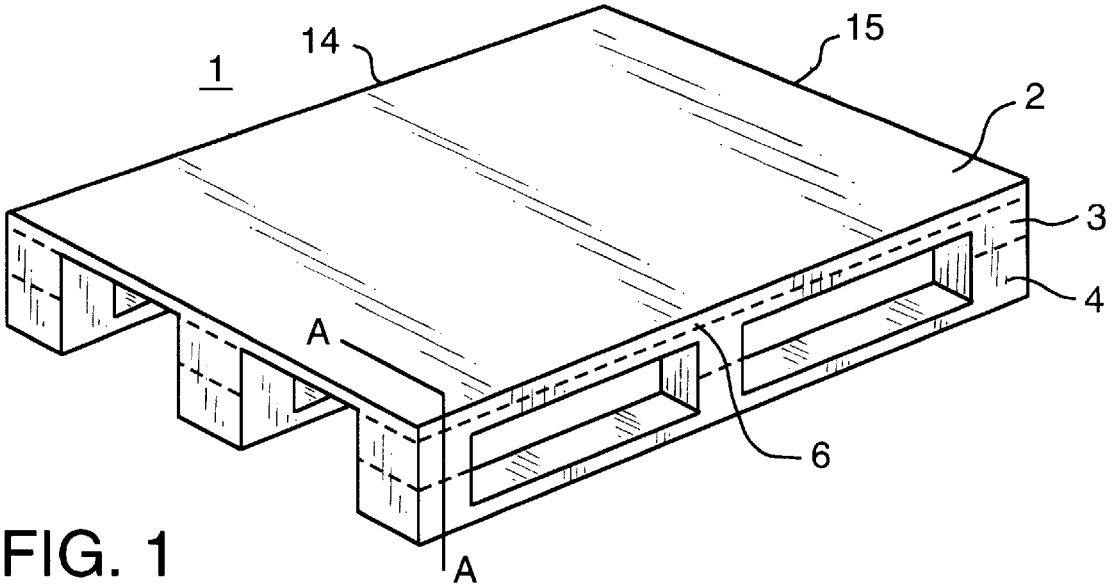
FIG. 1 is a perspective sketch of a finished fabricated pallet.

The pallet according to the invention is assembled from individually fabricated structural components comprising a pallet deck and one or more sets of runner components, each of which consists of an upper runner component and a lower runner component. The structural components are fabricated by the thermoforming of a coextruded parison having a wall thickness matching the product specifications and required product characteristics. In the fabrication of the individual structural components, the entire parison or parts of the parison is/are flattened, while at the same time it is given the required shape by using combinations of compressed air and vacuum.

In its simplest embodiment the parison consists of a homogeneous (solid) material. In order to make the extruded structure lighter, the parison can be coextruded with several layers, where at least one layer is at least partially foamed.

Present-day coextrusion technology permits a number of options for the parison's shape and structure, which anyone skilled in the art in the field of plastic extrusion is quite familiar with. For instance, the extruded structure, with one specific embodiment of the invention, can consist of a foamed plastic layer having a solid skin on just one side. The foam should preferably have a closed-cell structure, and in practice it can have a density of down to approximately 100 $kg/m^3$. The skin will form the pallet's outsides, so that a wear-resistant and easy-to-clean surface is attained.

With another specific embodiment of the invention, the extruded structure comprises a foamed plastic layer having a solid skin on both sides, or optionally multiples of such a multilayer structure. Such a sandwich structure will, it is common knowledge, have high torsional rigidity and produce a lightweight construction. The foam layer typically comprises about 70% of the sheet structure's thickness, and each skin layer about 15%, more preferably about 80% and about 10%, respectively. Because the foam has a closed-cell structure, in some cases it can even constitute the entire wall thickness. The foam can have a density within the range of from the density of a solid material down to as far as it is possible in practice to produce a stable polymeric foam. There has to be very good adhesion between the foam and skin layer in order to attain an optimal rigid structure. Consequently, the foam and skin have to be coextruded in such a way that an integrated multilayer structure is produced.

Suitable materials for producing the extruded parison having a multilayer structure comprise in principle all extrudable thermoplastics having sufficient rigidity. Especially suited thermoplastics are polyolefins, polyvinyl chloride (PVC), acrylonitrile butadiene (ABS), styrene plastics, polyamides (PA) and polycarbonates (PC). Of these, polyolefin materials are preferred. However, there is nothing to prevent the foam material and the skin layer, or layers, from being made of different materials. For instance, an inside and outside layer of ultrahigh molecular weight high-density polyethylene (HDPE-HMW) and an intermediate layer of foamed HDPE will comprise a suited structure. Another structure has an inside layer of PP homopolymer, an outside layer of PP block copolymer, and an intermediate layer of foamed PP. Of course, other structures are also possible and fall within the scope of the invention.

The materials constituting the solid part of the extruded multilayer structure can, if desired, be reinforced with cut glass fibers and/or continuous glass fibers in the direction of extrusion.

During extrusion of the parison or forming of the components of the pallet, manufacturing waste will be produced which, for economic reasons, should be returned to production. This can be done by incorporating the waste material into one or more layers in the coextruded multilayer structure. Consequently, in practical embodiment of the invention, it will be advantageous to use materials that can be mixed with one another. Polyolefin materials are excellently suited in this respect, especially certain types of polypropylene (PP) and high-density polyethylene (HDPE). Smaller amounts of glass fibers in the skin layers can after grinding of the material be re-extruded and without problems included in the skin layers, and even in the foam layer(s).

It is also possible to add to the thermoplastics crosslinking agents in order to crosslink the material in the pallets produced. The disadvantage here is that this kind of manufacturing waste cannot be recycled. Another disadvantage is that the pallets then as a rule can be joined together only mechanically, though there do exist silane-based crosslinking agents that can be crosslinked after the finished pallet has been made.

It is of course possible to add to the plastic materials the additives and auxiliary agents that are customary for thermoplastics, such as antistatic agents, heat- and UV stabilizers, dyes, etc. The various layers of the multilayer structure can be of dissimilar colors, as desired. It is also possible for different components of the pallet to be of dissimilar colors, and, furthermore, pallets intended for dissimilar purposes can have different color codes.

DETAILED DESCRIPTION OF DRAWINGS

Preferred specific embodiments of the pallet will now be explained in more detail with reference to the attached drawings.

FIG. 1 shows a specific embodiment of the finished pallet, 1, with the pallet deck, 2, joined together with upper runner components, 3, and lower runner components, 4. The joints between the pallet deck, 2, and between the upper and lower runner components, 3 and 4, are indicated by dotted lines.

Figure 2:
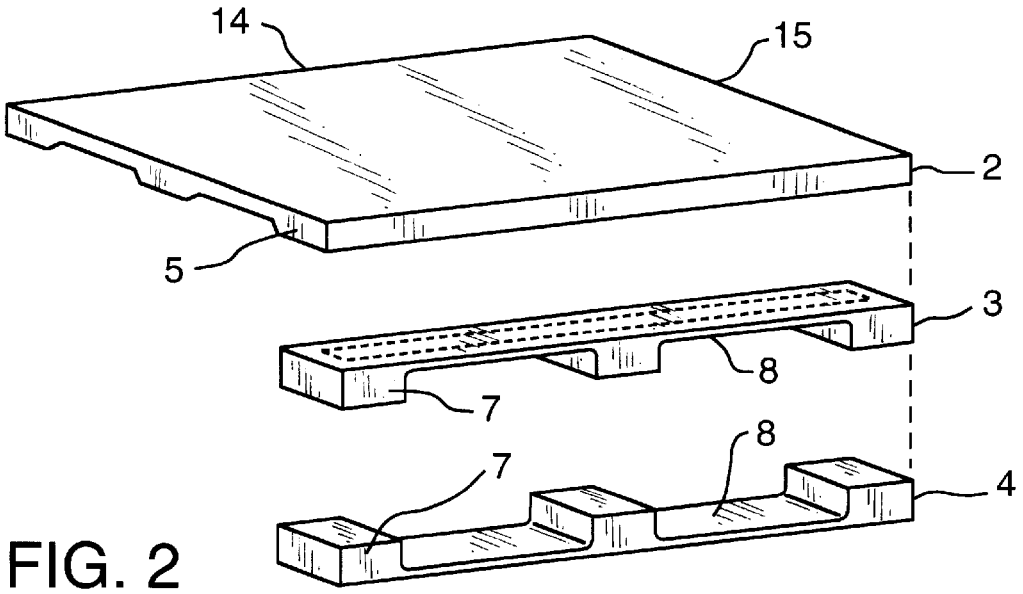
FIG. 2 a perspective sketch of a pallet deck and runner components prior to joining together.

FIG. 2 shows the pallet deck, 2, upper runner component, 3, and lower runner component, 4, before joining together. The deck is formed from the tubular structure as a single piece in the form of a continuous sheet having a longitudinal side, 14, and a transverse side, 15. Profiles, 5, are formed on the bottom of the deck along each longitudinal side, 14, and in the center. Each runner component, 3 and 4, is formed as a single piece from the tubular structure, with posts, 7, at each end and in the center, and between these the parison is squeezed flat so that the insides of the parison are fused together and form a cross member, 8, that holds the posts, 7.

Figure 3:
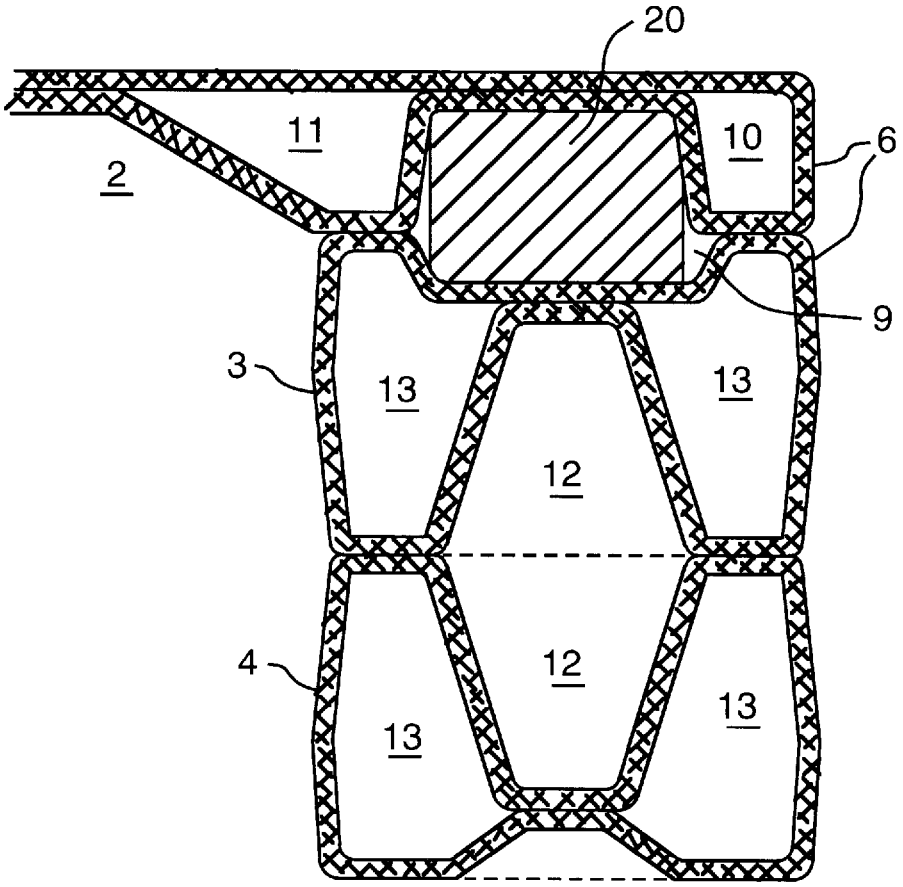
FIG. 3 is a sectional view through part of the pallet deck, posts and runner components for the assembled pallet.

FIG. 3 is a sectional view through the finished pallet, 1, at section A—A in FIG. 1. The section runs through the pallet deck, 2, one post on the upper runner component, 3, and one post on the lower runner component, 4. The deck, 2, and upper runner component, 3, are welded together, or joined together in another way, with the entire contact surface of the runner component's cross member, 8, towards the bottom of the profile, 5, on the pallet deck, 2. The profile, 5, and the cross member, 8, on the upper runner component, 3, will thus form the longitudinal side walls, 6, of the pallet. The pallet deck is formed so that the profile, 5, forms a channel, 9, and two closed hollow spaces, 10 and 11. The upper runner component is shaped so that a channel is formed on the top of the cross member and longitudinally, that has the same width as the channel, 9, on the bottom of the pallet deck. Consequently, a closed channel, 9, extending longitudinally along the pallet is created when the pallet deck, 2, and the upper runner component, 3, are joined together. The channel's length, width and depth can be made to fit the requirements. The deck and the upper runner component are formed so that each channel, 9, is sealed at each end so that a closed hollow space is created. Optionally, the forming can be such that the channel is open at both ends. The upper and lower runner components, 3 and 4, are joined together with the posts' contact surfaces towards one another. The lower runner component, 4, is in principle formed like the upper runner component, 3, but so that the cross member, 8, constitutes the contact surface towards the floor. Each post on the upper and lower runner components, 3 and 4, is formed as a symmetric profile so that two like-shaped hollow spaces, 13, and a channel, 12, are created, that will also create a closed hollow space when the posts are joined together. The hollow spaces, 10–13, created contribute to making the pallet lightweight. The shape of the pallet's posts can differ designwise from that sketched in FIG. 3 by variations in the dimensions of the channel, 9, and hollow spaces, 12 and 13. However, the bearing walls in the posts must be formed so that a sufficiently rigid structure is attained.

It is specified above that the runners, 3 and 4, are fastened to the pallet deck, 2, longitudinally, but they can of course just as well be fastened transversely along the pallet deck. At the same time, the pallet can also have one or more runners along both the longitudinal side, 14, and along the transverse side, 15. In one specific embodiment the pallet has one runner along the longitudinal side, 14, and one runner along the transverse side, 15, so that the runners are perpendicular to one another and form a cross. It can also be of interest to have two or more runners in each direction. When runners are used that are perpendicular to one another, the runner components have to be formed in a suitable manner at the points where they cross.

The individual components of the pallet can be joined together most expediently by welding, preferably by butt welding, but other methods of joining like the use of glue or adhesive can also be employed. Optionally, the individually fabricated structural components can be joined together mechanically by means of snap-together arrangements, clips, bolts made of plastic or metal, or combinations of the same.

Suitable stiffening sections can be inserted into the channels, 9, in FIG. 3, along the pallet deck's side edges and along the center, in order to ensure that the pallet does not deflect at its center under great stresses. It is preferable to use components made of a lightweight metal in order to not increase to an unnecessary degree the pallet's unloaded weight. Sections fabricated from other materials can also be used, e.g., of plywood or suitable plastic materials.

Because plastic materials, and especially polyolefins like HDPE and PP, have a rather smooth surface, it will often be desirable to add to the pallet deck a friction-increasing material. This can be done by extruding an extra layer with a friction material on the outside of the tube at the same time as the tube is being extruded. The friction material is added in the form of parallel, raised longitudinal sections having a height of approximately 1 mm and a width of from narrow strips to a continuous facing around the entire periphery of the tube or around parts of its periphery. Thus, the pallet deck will be furnished on its top, and optionally also on its bottom, with several parallel, raised longitudinal sections of the coextruded friction material. The friction material on the top of the pallet deck will prevent goods from sliding off the pallet, while the friction strips on the bottom will prevent the pallet from sliding easily off truck forks when the pallet is being handled. The latter can be further improved by extruding friction strips also on the bottom of the top runner component. When the pallet is fabricated from a polyolefin material, a suitable friction material is selected from among polyolefin-containing materials like EVA, EBA and the like. The pallet's smooth and even surface helps to make it very simple and easy to clean and disinfect. It is therefore especially well suited for use in the food industry and allied industries. The pallet can also be used as a stackable pallet for storage, but then it should be stiffened with suitable stiffening sections. When the pallet is used for storage or transportation in engineering manufacturing concerns, the pallet deck can be shaped according to the shape of the actual product that is to be transported, in order to ensure stability during transportation. The pallet according to the invention will have a substantially longer service life in comparison with wooden pallets, so that, in spite of its higher manufacturing cost, it will be cost-effective to use. When the pallet is worn out it can simply be recycled along the line of other thermoplastic articles.

I claim:

1. A pallet made of a thermoplastic material, the pallet fabricated by joining together a plurality of individually fabricated structural components, each of the structural components being individually thermoformed from an extruded plastic parison having a multilayer structure, the structural components comprising:

(a) a deck (2) in the form of a continuous sheet having a longitudinal side (14), a transverse side (15), and top and bottom surfaces, (b) at least one upper runner component (3) having top and bottom surfaces, each said upper runner component (3) comprising a cross member (8) having downward-facing posts (7) and being fastened by its said top surface to said bottom surface of said deck (2), and (c) at least one lower runner component (4), each said lower runner component (4) comprisinq a cross member (8) having upward-facing posts (7), each said upward-facing post fastened to one said downward-facing post of a corresponding said upper runner component (3).

2. A pallet according to claim 1 wherein at least one said upper runner component (3) fastened to one said lower runner component (4) is positioned along said longitudinal side (14) and along said transverse side (15).

3. A pallet according to claim 2 wherein one said upper runner component (3) fastened to one said lower runner component (4) is positioned along a said transverse side and has a length substantially equal to said second length.

4. A pallet according to claim 1 wherein at least one of said top surface of each said upper runner component and the part of said deck to which said upper runner component is fastened is formed with a longitudinal recess, so that a straight open channel (9) is created between said upper runner component and said deck.

5. A pallet according to claim 4 wherein each said channel (9) is sealed at each end so that a closed hollow space is created.

6. A pallet according to claim 4 wherein a stiffening section is inserted into one or more of said channels (9).

7. A pallet according to claim 1 wherein the extruded multilayer structure is fabricated from a thermoplastic selected from polyolefins, PVC, ABS, styrene plastics, PA and PC.

8. A pallet according to claim 7 wherein said thermoplastic is reinforced with a reinforcing material selected from cut glass fibers and continuous glass fibers, said reinforcing material running in the direction of extrusion.

9. A pallet according to claim 1 wherein the extruded multilayer structure comprises a foamed plastic layer having a solid skin on one side thereof.

10. A pallet according to claim 9 wherein said foamed layer and said solid skin are coextruded so that they create an integrated multilayer structure.

11. A pallet according to claim 9 wherein said foamed layer and said solid skin are made of different materials.

12. A pallet according to claim 9 wherein said extruded multilayer structure comprises at least one polyolefin material.

13. A pallet according to claim 12 wherein said foamed layer has a closed cell structure.

14. A pallet according to claim 1 the extruded multilayer structure comprises at least one foamed plastic layer having a solid skin on both sides thereof.

15. A pallet according to claim 1 wherein the structural components are joined together by butt welding.

16. A pallet according to claim 1 wherein the structural components are joined together by the use of a material selected from glue and adhesive.

17. A pallet according to claim 1 wherein the structural components are joined together mechanically by one or more fastening means selected from snap-together arrangements, clips, bolts made of plastic, and bolts made of metal.

18. A pallet according to claim 1 wherein at least one of said top and bottom surfaces of said deck are furnished with a plurality of parallel, raised longitudinal sections made of a coextruded friction material.

19. A pallet according to claim 18 wherein said bottom surface of said upper runner component is furnished with one or more raised longitudinal sections made of a coextruded friction material.

20. A pallet according to claims 18 or 19 wherein said friction material is a polyolefin material.

21. A pallet according to claim 20 wherein said polyolefin material is EVA.

22. A pallet according to claims 17 or 18 wherein said parallel, raised longitudinal sections have a height of about 1 mm and a width of from narrow strips to a continuous facing.

23. A pallet according to claims 1, 2, or 4 wherein said deck includes one or more structures selected from raised areas and recesses made to fit articles that are to be disposed on the pallet.

24. A pallet made of a thermoplastic material, the pallet fabricated by joining together a plurality of individually fabricated structural components, each of the structural components being individually thermoformed from an extruded plastic parison having a multilayer structure, the structural components comprising:

(a) a deck (2) in the form of a continuous sheet having two longitudinal sides (14) of a first length, two transverse sides (15) of a second length, and top and bottom surfaces, (b) at least two upper runner components (3), each said upper runner component comprising top and bottom surfaces and a cross member (8) having downward-facing posts (7), having a length substantially equal to said second length, and being fastened by said top surface to said bottom surface of said deck (2), each said upper runner component disposed substantially parallel to a said transverse side, and (c) at least two lower runner components (4) comprising a cross member (8) having upward-facing posts (7), each said upward-facing post fastened to one said downward-facing post of a corresponding said upper runner component (3).

25. A pallet according to claim 24 wherein one said upper runner component (3) fastened to one said lower runner component (4) is positioned along at least each said transverse side (14) of said deck.

26. A pallet according to claim 25 wherein one said upper runner component (3) fastened to one said lower runner component (4) also is positioned along a said longitudinal side and has a length substantially equal to said first length.

27. A pallet made of a thermoplastic material, the pallet fabricated by joining together a plurality of individually fabricated structural components, each of the structural components being individually thermoformed from an extruded plastic parison having a multilayer structure, the structural components comprising:

(a) a deck (2) in the form of a continuous sheet having two longitudinal sides (14) of a first length, two transverse sides (15) of a second length, and top and bottom surfaces, (b) at least two upper runner components (3), each said upper runner component comprising top and bottom surfaces and a cross member (8) having downward-facing posts (7), one said upper runner component having a length substantially equal to said second length, being fastened by its said top surface to said bottom surface of said deck (2), and disposed substantially parallel to a said transverse side, and the other said upper runner component having a length substantially equal to said first length, being fastened by its said top surface to said bottom surface of said deck (2), and disposed substantially parallel to a said longitudinal side, and (c) at least two lower runner components (4) comprising a cross member (8) having upward-facing posts (7), each said upward-facing post fastened to one said downward-facing post of a corresponding said upper runner component (3).

* * * * *

UNITED STATES PATENT AND TRADEMARK OFFICE

CERTIFICATE OF CORRECTION

PATENT NO. : 5,845,588
DATED : December 8, 1998
INVENTOR(S) : Gronnevik

It is certified that error appears in the above-identified patent and that said Letters Patent is hereby corrected as shown below:

Please replace claims 1 and 2 with the claims as indicated below:

1. A pallet made of a thermoplastic material, the pallet fabricated by joining together a plurality of individually fabricated structural components, each of the structural components being individually thermoformed from an extruded plastic parison having a multilayer structure, the structural components comprising:

(a) a deck (2) in the form of a continuous sheet having two longitudinal sides (14) of a first length, two transverse sides (15) of a second length, and top and bottom surfaces, (b) at least two upper runner components (3) comprising top and bottom surfaces, each said upper runner component (3) comprising a cross member (8) having downwards-facing posts (7), having a length substantially equal to said first length, and being fastened by its said top surface to said bottom surface of said deck (2), each said upper runner component disposed substantially parallel to a said longitudinal side, and ( c) at least two lower runner components (4), each said lower runner component (4) comprising a cross member (8) having upward-facing posts (7), each said upward-facing post fastened to one said downward-facing post of a corresponding said upper runner component (3).

2. A pallet according to Claim 1 wherein one said upper runner component (3) fastened to one said lower runner component (4) is positioned along each said longitudinal said (14) of said deck.

Signed and Sealed this

Twenty-first Day of August, 2001

*Attest:*

Nicholas P. Godici

NICHOLAS P. GODICI

*Attesting Officer*

*Acting Director of the United States Patent and Trademark Office*